US011705022B1

(12) United States Patent
Pearson

(10) Patent No.: US 11,705,022 B1
(45) Date of Patent: Jul. 18, 2023

(54) GARDEN MARKER

(71) Applicant: Daniel Dean Pearson, Henderson, KY (US)

(72) Inventor: Daniel Dean Pearson, Henderson, KY (US)

( * ) Notice: Subject to any disclaimer, the term of this patent is extended or adjusted under 35 U.S.C. 154(b) by 0 days.

(21) Appl. No.: 16/873,919

(22) Filed: Aug. 13, 2020

Related U.S. Application Data

(60) Provisional application No. 62/995,482, filed on Jan. 28, 2020.

(51) Int. Cl.
*G09F 3/20* (2006.01)

(52) U.S. Cl.
CPC ..... *G09F 3/206* (2013.01)

(58) Field of Classification Search
CPC ..... G09F 3/206
See application file for complete search history.

(56) References Cited

U.S. PATENT DOCUMENTS 1,896,695 A * 2/1933 Borovicka ..... G09F 3/206 40/645
1,983,815 A * 12/1934 Schmiett ..... A01C 5/02 47/1.01 R
4,027,410 A * 6/1977 Wheeler ..... G09F 3/206 40/645
4,079,530 A * 3/1978 Atherton ..... G09F 3/206 40/645
4,304,059 A * 12/1981 Tisbo ..... G09F 3/206 40/645
4,534,125 A * 8/1985 Buck ..... G09F 3/206 40/645
4,972,616 A * 11/1990 Doll ..... G09F 3/04 40/607.05
D443,310 S * 6/2001 Faulkner ..... D20/26
2016/0366835 A1* 12/2016 Russell ..... G09F 3/08
2018/0253995 A1* 9/2018 Amend ..... B65D 77/28

OTHER PUBLICATIONS

"Laser Engraving Garden Markers," https://web.archive.org/web/20190829065750/https://www.epiloglaser.com/resources/sample-club/laser-engraving-wooden-spoons.htm (Year: 2019).*
"Cast Iron Herb Stakes," https://www.alisorganics.com/products/cast-iron-herb-stakes, Aug. 9, 2015. (Year: 2015).*

* cited by examiner

*Primary Examiner* — Gary C Hoge
(74) *Attorney, Agent, or Firm* — Gary K. Price

(57) ABSTRACT

A garden marker with features of convenience for a gardener.

6 Claims, 3 Drawing Sheets

© 2020 DANIEL DEAN PEARSON II

© 2020 DANIEL DEAN PEARSON II

© 2020 DANIEL DEAN PEARSON II

GARDEN MARKER

CROSS REFERENCES TO RELATED APPLICATIONS

Provisional Application for Patent No. 62/995,482 filed Jan. 28, 2020 with the same title, Garden Marker, which is incorporated by reference. Applicant claims priority on material disclosed pursuant to 35 U.S.C. Par 119(e)(i).

A portion of the disclosure for this patent document contains material which is subject to copyright protection. The copyright owner has no objection to the facsimile reproduction of by anyone of the patent document or the patent disclosure, as it appears in the Patent and Trademark Office patent file or records, but otherwise reserves all copyrights whatsoever.

STATEMENTS REGARDING FEDERALLLY SPONSORED RESEARCH AND DEVELOPMENT

Not applicable

THE NAMES OF THE PARTIES TO A JOINT RESEARCH AGREEMENT

Not applicable

INCORPORATION BY REFERENCE OF MATERIAL SUBMITTED ON A COMPACT DISC OR AS A TEXT FILE VIA THE OFFICE ELECTRONIC FILING SYSTEM (EFS-WEB)

Not applicable

STATEMENT REGARDING PRIOR DISCLOSURES BY THE INVENTOR OR A JOINT INVENTOR

Not applicable

BACKGROUND OF THE INVENTION

(1) Field of the Invention

This invention relates to a gardening accessory comprising a scale useful for planting depth and spacing, color coded to match a given vegetable, a crop label, a crop tag, and an end shape for furrowing.

2. Background Information

Many gardeners mark where they have planted a given crop with a seed package on a stick by the planting side. This approach tends to not withstand the elements very well.

Also other devices are used to measure plant spacing, planting depth, and furrowing.

As will be seen in the subsequent descriptions of the preferred embodiment of the present invention, the present invent addresses existing deficiencies of the prior art.

BRIEF SUMMARY OF THE INVENTION

A gardening accessory that serves as a garden marker comprising a scale useful for measuring planting depth and spacing, color coded to match a given vegetable, a crop label, a crop icon at a proximate end, and a reinforcing rib and a furrowing nose at the distal end. The preferred material is a moldable plastic such as, but not restricted to, Polypropylene™.

DETAILED DESCRIPTION OF THE INVENTION

Figure 1:
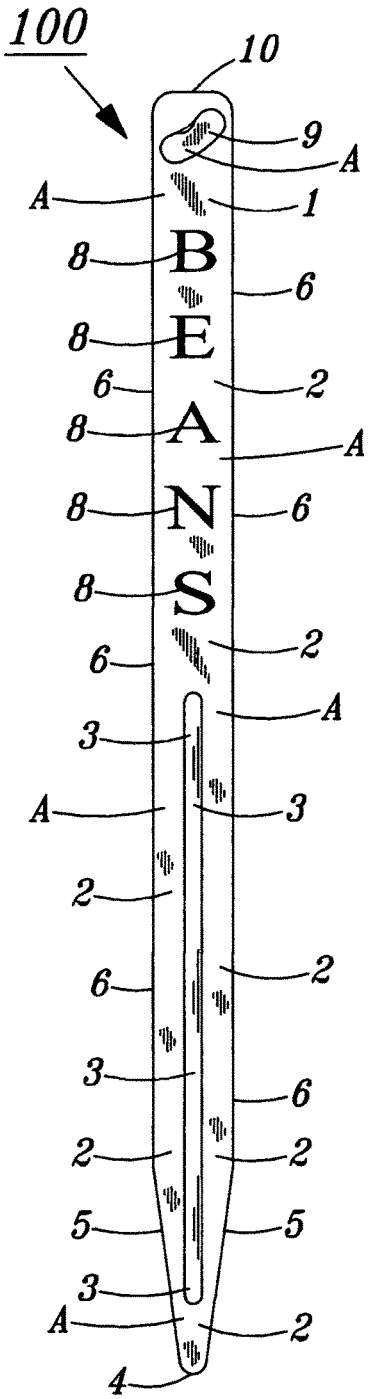
FIGS. 1 through 8 illustrate the preferred embodiments of the present invention, a garden marker.
Figure 2:
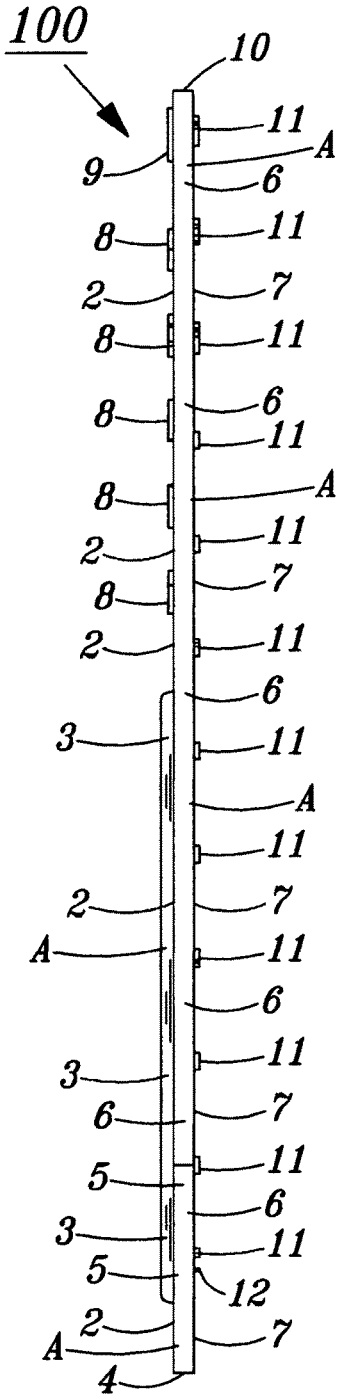
Figure 3:
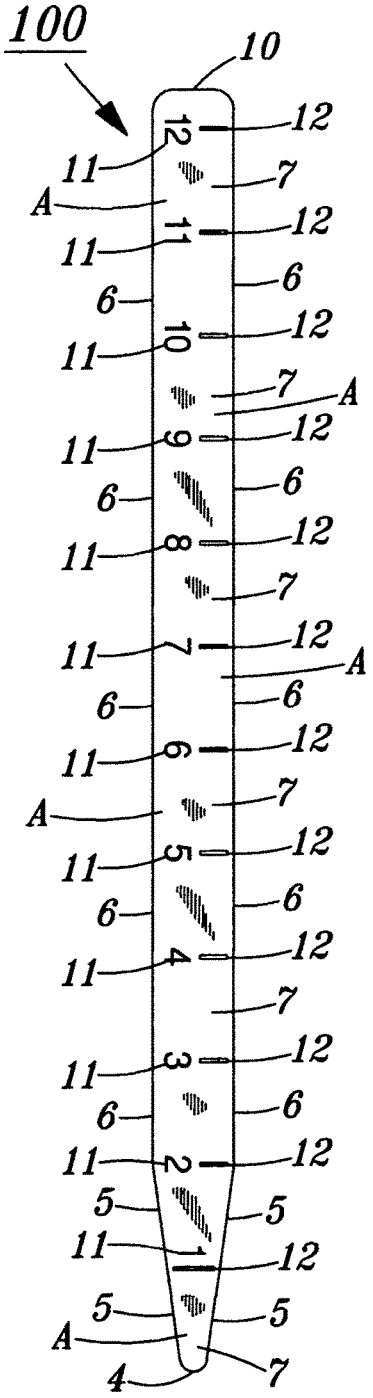
Figure 4:
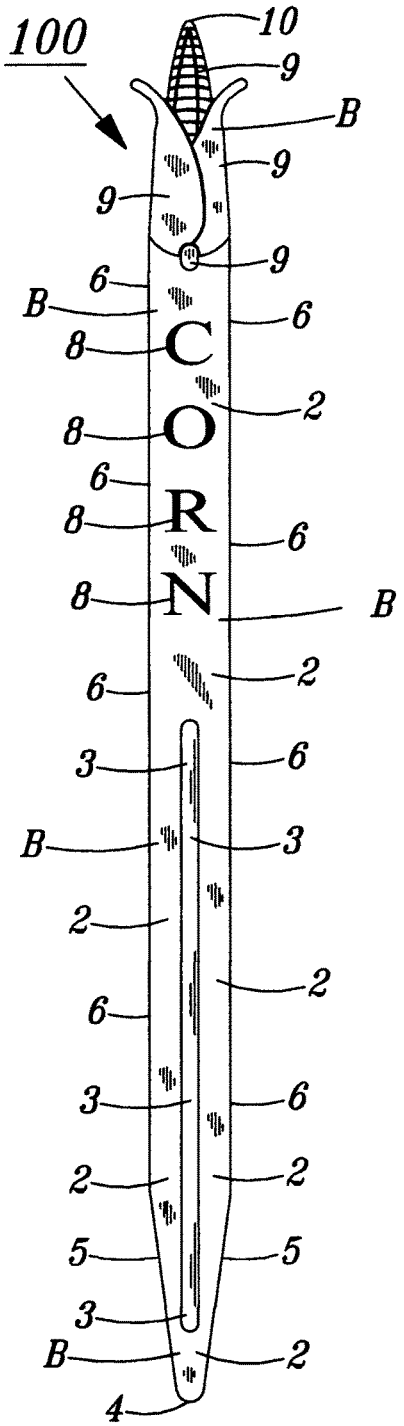
Figure 5:
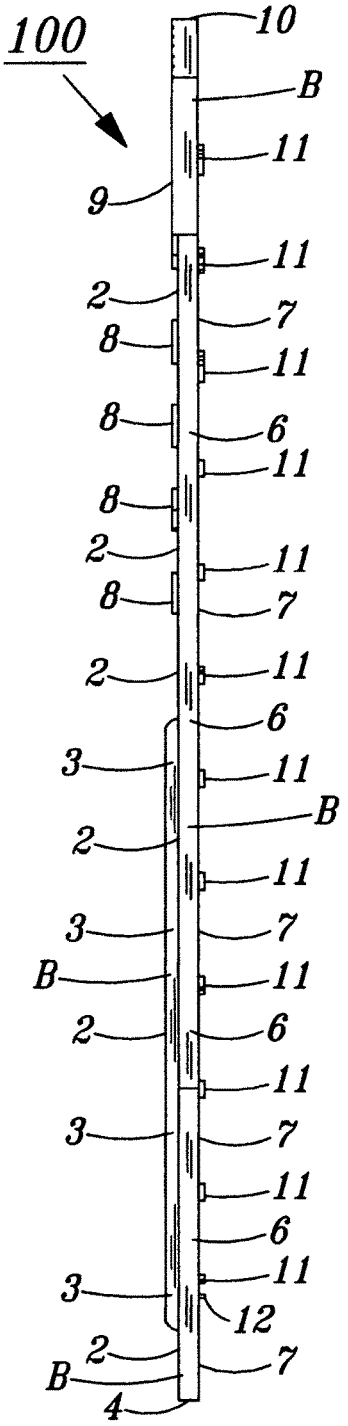
Figure 6:
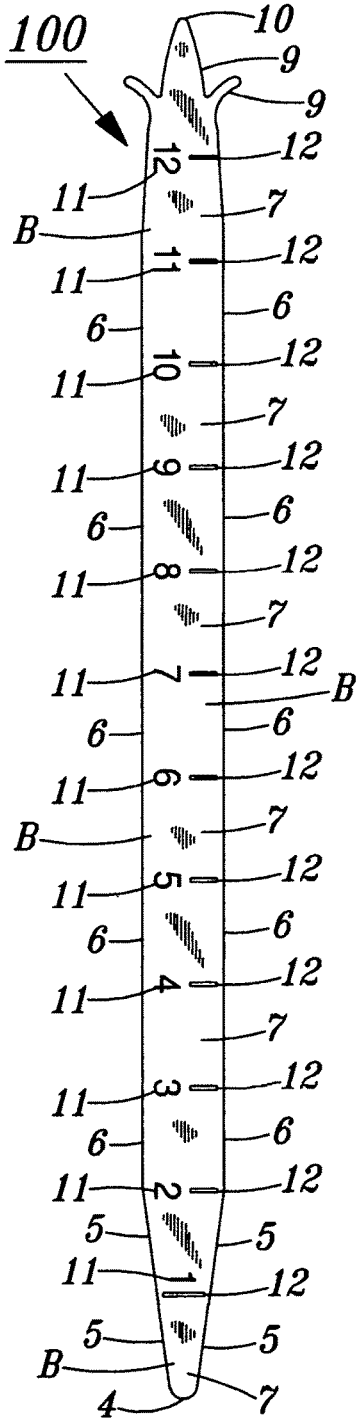
Figure 7:
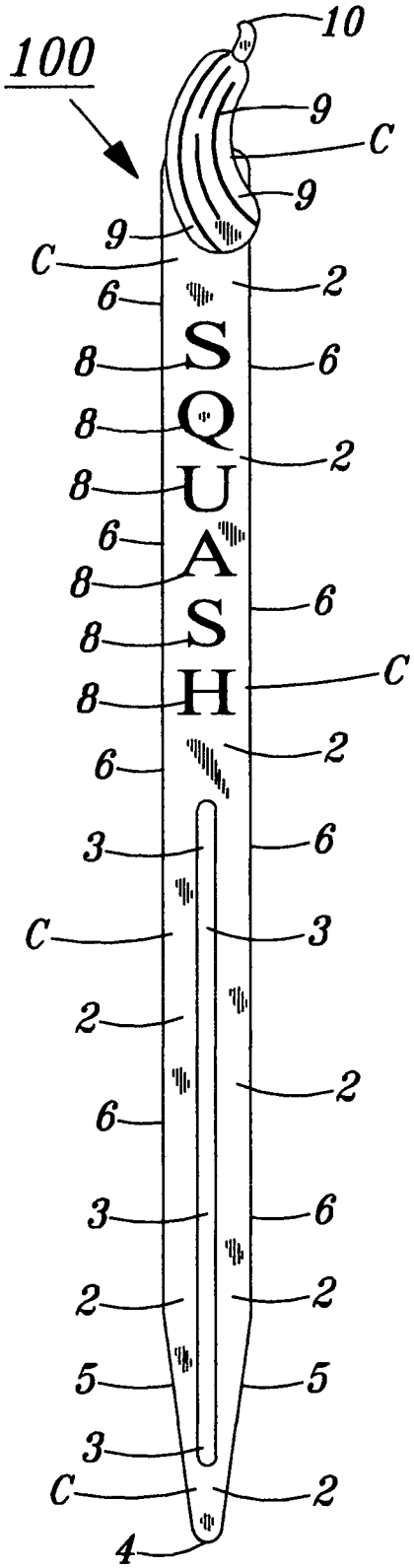
Figure 8:
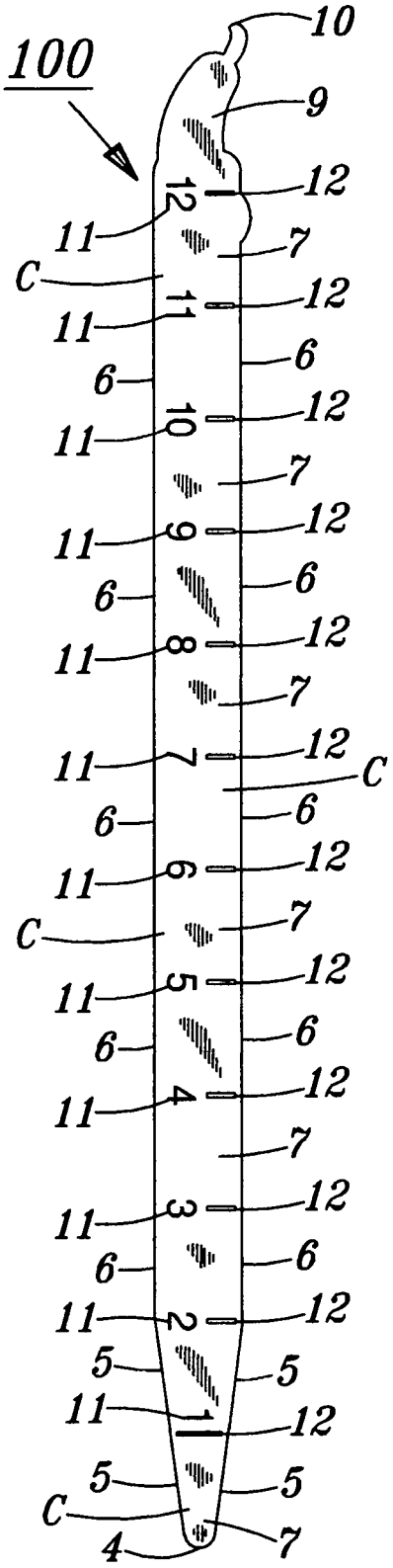

Referring to FIGS. 1 through 8, the preferred embodiments of the present invention, a garden marker 100 stake 1 comprising a front surface 2, a reinforcing rib 3, a furrowing nose 4, angled distal end surfaces 5, side walls 6 for vertical stabilization, a back surface 7, letter labeling 8, an icon 9, a top surface 10, and measurement details 11 and 12.

The material, in the preferred embodiment of the present invention is, but not restricted to, Polypropylene™. The material is labeled in the FIGS. 1 through 10, by color codes: A for green, B for yellow, C for beige, and D for red, as specific examples of choices. As obvious to anyone skilled in the art, there are many color choices, to match the variety of potential crops.

The letter labeling 8 and the measurement details 11 and 12, in the preferred embodiment of the present invention, may be, but not restricted to, raised or recessed letter labeling 8 and measurement details 11 and 12.

In the preferred embodiment of the present invention, a gardener, when planting beans, the garden marker 100 with the proximate end icon 9 representing a green bean and with the material color choice A for Green, may be of interest. The furrowing nose 4 can be used to trace a furrow for seeding, while the measurement details 11, 12 can be of assistance in both measuring a desired depth of seed as well as speed spacing. The lettering 8 in this example would be the product beans to assist the gardeners in identifying the location of the beans planted.

The reinforcing rib 3 reinforces the stake 1.

The angled distal end surfaces 5 assist the gardener in inserting the garden marker 100 into a garden to assist in identifying what was planted.

Although the description above contains many specificites, these should not be construed as limiting the scope of the invention, but as merely providing illustrations of some of the preferred embodiments of the present invention. It will be obvious to those skilled in the art that modifications may be made to the embodiments described above without departing from the scope of the present invention.

Thus the scope of the invention should be determined by the appended claims in the formal application and their legal equivalents, rather than by the examples given.

SEQUENCE LISTING Not applicable

I claim:

1. A garden marker stake comprising:

a single component having a front surface, a back surface, a reinforcing rib, a lower end that is tapered and defines a furrowing nose, angled distal end surfaces, side walls, a top surface disposed at a top end of the garden marker stake, and measurement details, and wherein said garden marker stake defines a straight portion that extends from said top end to an upper portion of said lower end, and wherein the entire width of said straight portion has a same width, and wherein said straight portion defines a length, and said reinforcing rib is located along a longitudinal center line on said front surface and extends between a first point and a second point, where said first point is approximately halfway between a midway point along a length of said tapered distal end and an lower end of the tapered distal end, and said second point is an approximate midway point along said length of said straight portion, wherein the top surface defines an end icon that depicts a crop product and is integral to the top surface, and wherein the icon, is raised on the top surface, wherein the measurement details enable a gardener to measure both depth of seed planting as well as plant spacing, wherein the furrowing nose is usable for tracing a furrow for seeding, and wherein the side walls stabilize the stake vertically, letter labeling that is integral to the garden marker stake, and wherein the letter labeling is raised letter labeling and is disposed on said front surface between said top surface and a top end of said reinforcing rib and wherein said reinforcing rib is raised on said front surface.

2. The garden marker stake of claim 1 further comprising color coding for identifying the crop product.

3. A garden marker stake comprising:

a single component having a tapered distal end, a top end disposed opposite said tapered distal end, a front surface, and wherein said garden marker stake defines a straight portion that extends from said top end to an upper portion of said tapered distal end, and wherein said straight portion has a same width, a reinforcing rib located along a longitudinal center line of said front surface and extends from a point near an end of the tapered distal end to an approximate midway point along a length of said straight portion, said reinforcing rib is raised on said front surface, letter labeling that is integral to the garden marker stake, and wherein the letter labeling is raised letter labeling and is disposed on said front surface between said top end and a top end of said reinforcing rib.

4. The garden marker stake of claim 3, further including measurement details to enable a gardener to measure both depth of seed planting as well as plant spacing.

5. The garden marker stake of claim 4, further including a furrowing nose configured for tracing a furrow for seeding.

6. The garden marker stake of claim 5, further including side walls to stabilize the garden marker stake.

* * * * *